US007913768B2

(12) United States Patent
Hallundbaek et al.

(10) Patent No.: US 7,913,768 B2
(45) Date of Patent: Mar. 29, 2011

(54) RELEASE DEVICE

(75) Inventors: Jørgen Hallundbaek, Graested (DK); Peter Graabaek, Greve (DK)

(73) Assignee: Welltec A/S, Allerod (DK)

( * ) Notice: Subject to any disclaimer, the term of this patent is extended or adjusted under 35 U.S.C. 154(b) by 0 days.

(21) Appl. No.: 12/595,766

(22) PCT Filed: Apr. 14, 2008

(86) PCT No.: PCT/DK2008/000131

§ 371 (c)(1),
(2), (4) Date: Nov. 4, 2009

(87) PCT Pub. No.: WO2008/125108

PCT Pub. Date: Oct. 23, 2008

(65) Prior Publication Data

US 2010/0065283 A1 Mar. 18, 2010

(30) Foreign Application Priority Data

Apr. 13, 2007 (DK) ..... 2007 00542

(51) Int. Cl.
*E21B 23/00* (2006.01)
*E21B 17/06* (2006.01)
*E21B 7/00* (2006.01)

(52) U.S. Cl. ..... 166/382; 166/242.6; 175/256; 175/320

(58) Field of Classification Search ..... 166/377, 166/382, 242.6; 175/24, 57, 256, 320
See application file for complete search history.

(56) References Cited

U.S. PATENT DOCUMENTS

| | | | | | |
|---|---|---|---|---|---|
| 2,080,978 | A | * | 5/1937 | Church | 175/44 |
| 3,169,592 | A | | 2/1965 | Kammerer | |
| 3,241,624 | A | * | 3/1966 | Rassieur | 175/257 |
| 3,346,059 | A | * | 10/1967 | Svendsen | 175/246 |
| 3,627,067 | A | * | 12/1971 | Martinsen | 175/58 |
| 3,700,049 | A | * | 10/1972 | Tiraspolsky et al. | 175/50 |
| 3,818,997 | A | * | 6/1974 | Bridwell | 175/57 |
| 3,888,306 | A | | 6/1975 | Wetzel | |
| 4,834,198 | A | * | 5/1989 | Thompson | 175/244 |
| 5,086,852 | A | * | 2/1992 | van Buskirk | 175/269 |
| 5,267,620 | A | * | 12/1993 | Lee | 175/230 |

(Continued)

FOREIGN PATENT DOCUMENTS

WO WO98/01652 1/1998

(Continued)

OTHER PUBLICATIONS

International Search Report dated Aug. 15, 2008.

(Continued)

*Primary Examiner* — Jennifer H Gay
(74) *Attorney, Agent, or Firm* — Cohen Pontani Lieberman & Pavane LLP

(57) ABSTRACT

A downhole system including a driving unit for driving an operational tool. The driving unit is provided in a first part of the system and the operational tool is provided in a second part of the system. The system further includes a release device for releasing the operational tool and the second part from the first part of the system.

13 Claims, 6 Drawing Sheets

U.S. PATENT DOCUMENTS

| | | | | |
|---|---|---|---|---|
| 5,322,139 | A | 6/1994 | Rose et al. | |
| 5,450,913 | A | 9/1995 | Mefferd et al. | |
| 5,934,393 | A * | 8/1999 | Marshall | 175/236 |
| 6,089,335 | A * | 7/2000 | Able | 175/246 |
| 6,269,891 | B1 | 8/2001 | Runia | |
| 6,848,506 | B1 | 2/2005 | Sharp et al. | |
| 2004/0041423 | A1 | 3/2004 | Cannon | |
| 2004/0238218 | A1 | 12/2004 | Runia et al. | |
| 2006/0081403 | A1 | 4/2006 | Mattila | |

FOREIGN PATENT DOCUMENTS

| | | |
|---|---|---|
| WO | WO2006/098634 | 9/2006 |

OTHER PUBLICATIONS

International Preliminary Report on Patentability dated Oct. 13, 2009.

* cited by examiner

RELEASE DEVICE

PRIORITY CLAIM

This is a U.S. national stage of application No. PCT/DK2008/000131, filed on Apr. 14, 2008. Priority is claimed on the following application: Denmark Application No.: PA 200700542, Filed Apr. 13, 2007, the content of which is incorporated here by reference.

TECHNICAL FIELD

The present invention relates to a downhole system for performing an operation downhole, e.g. drilling in a formation downhole. The system extends longitudinally and comprises a driving unit provided in a first part of the system for driving an operational tool, the operational tool provided in a second part of the system for performing the operation downhole, and a release device provided in the first part of the system for releasing the first part from the second part.

BACKGROUND

Downhole systems are used when performing an operation downhole such as drilling a well in the subterranean formation, cleaning a well, etc. Downhole systems are built from several tools specific for the operation to be performed. Even though the downhole system is built for a specific operation, some of the tools can be reused for another operation.

One downhole system is a drilling system comprising a drilling tool with a drilling head and a motor for driving the drilling tool. If the drilling head gets stuck while drilling, the drilling head may be destroyed; however, the rest of the system may still be intact and can thus be reused, unless it has been stuck together with the drilling head.

For solving this problem, several release devices have been made so that the drilling head can be released from the rest of the system when the drilling head gets stuck during drilling. The drilling head is released when a signal is sent from a control unit above surface to a power unit in the system, the power unit subsequently pressing a fluid into the release device wherein the pressurised fluid is used for a mechanical release of the drilling head.

In the event that the communication from above surface to the system has broken down, the drilling head cannot be released. Furthermore, if the power unit is stuck, the drilling head is also not released.

DESCRIPTION OF THE INVENTION

An aspect of the present invention is, at least partly, to overcome the disadvantages of the downhole systems mentioned above, and to provide an improved downhole system which is able to release a stuck operational tool even though the power from above surface is disconnected.

This aspect and the advantages becoming evident from the description below are obtained by a downhole system for performing an operation downhole, e.g. drilling in a formation downhole, and having a longitudinal extension, comprising:

- a driving unit provided in a first part of the system for driving an operational tool, the operational tool being provided in a second part of the system for performing the operation downhole and having a connection means, and
- a release device provided in the first part of the system, comprising:

- a set of arms movable in a substantially transverse direction to the longitudinal extension of the system, and
- a pushing means movable in the longitudinal extension of the system for pushing the arms in the transverse direction for engagement with the connection means of the operational tool, wherein the pushing means is powered by a power means for pushing the arms in the transverse direction and into engagement with the connection means of the operational tool, and releases the operational tool when being unpowered.

By having power means providing a continuous force on the pushing means in order for them to engage with the connection means, the downhole system is always able to release the first part even if the electrical power has been cut off from the system. This is due to the fact that the power means is unable to provide the force on the pushing means when the downhole system is unpowered.

In one embodiment, the set of arms may be freely movable and only held in place and in engagement with the connection means by the connection means and the pushing means.

Moreover, the pushing means may release the operational tool when the power means has been unpowered for a predetermined time period.

In one embodiment, the system may have a timer which controls the power means for a release of the operational tool. Moreover, such a timer may work electrically.

In one embodiment, the system may be powered through a wireline and the system may have a detection means to detect a current change in the wireline. The detection means may be a non-contact means, such as a pick-up, a capacitor, or a hall-sensor.

In one embodiment, the power means may power the pushing means by use of hydraulic and be driven by the driving unit via a piston.

In another embodiment, the power means may power the pushing means by a gear means driven by the driving unit.

In yet another embodiment, the power means may power the pushing means via a control unit by use of electricity.

Furthermore, the set of arms may be a part of a tube fastened, at its one end, to the first part of the tool and split into the set of arms at its other end.

Moreover, the pushing means may extend within the tube to push the set of arms in the substantially transverse direction.

In one embodiment, the arms may be made of a material, such as metal, allowing the pushing means to bend them in the transverse direction.

In addition, the pushing means may be a mandrel, a cone, or a tube.

Furthermore, the pushing means may move from the first part of the system towards the second part of the system for engagement with the connection means.

Also, the downhole system may further comprise a pump and/or a fluid cleaner.

In addition, the operational tool may be a packer element, a drilling tool, a perforation tool, or the like.

Furthermore, the invention relates to a release device in accordance with the above, and to use of such a release for releasing a operational tool from a driving unit of a downhole system.

Finally, the invention relates to an operation method comprising the steps of:

- turning on electrical power to a downhole system,
- connecting an operational tool to the downhole system by forcing a pushing means of the downhole system into engagement with a connection means of the operational tool, operating downhole by means of the operational tool, and automatically releasing the operational tool when the power to the downhole system is cut off.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
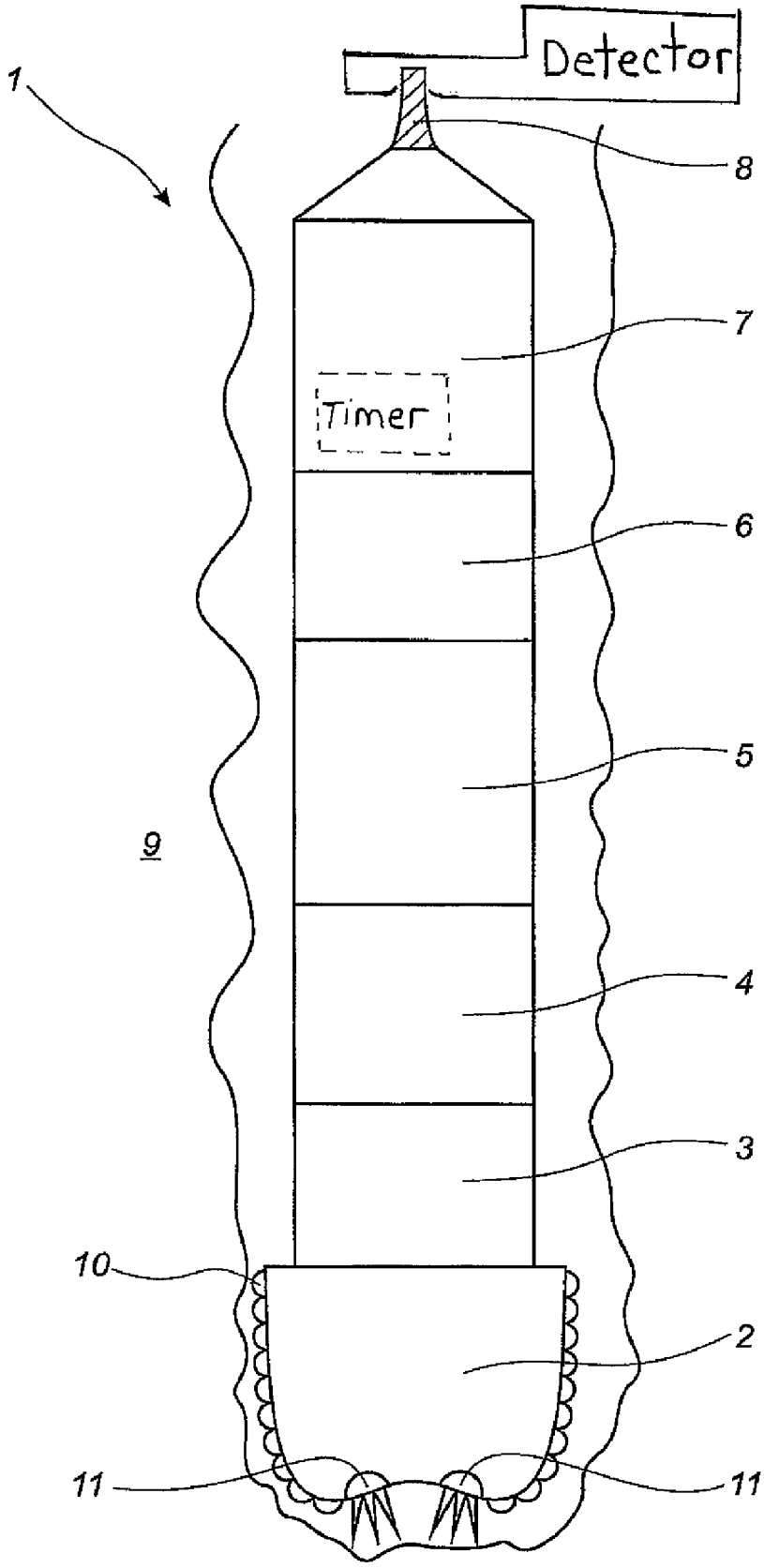
FIG. 1 shows a downhole system according to the invention.

FIG. 1 shows one embodiment of a downhole system 1 comprising a drilling head 2 and a driving unit 7 for rotating the drilling head 2. In between the driving unit 7 and the drilling head 2, the system 1 comprises a control unit 6, a fluid cleaner 5, a pump 4, and a release device 3 according to the invention.

The driving unit 7 may be any kind of motor, preferably an electrical motor getting power through the wireline 8. The drilling head 2 is rotationally driven by the driving unit 7 at a certain speed and at a certain weight on bit (WOB) so that the longitudinal displacement of the bit 10 towards e.g. the formation 9 is held constant during the drilling process.

The motor 7 has a shaft for driving the drilling head 2. The shaft may be connected to the drilling head 2 through a gear connection. In this way, one drilling head 2 may be replaced by another drilling head 2.

The control unit 6 is powered by the motor 7 for controlling the drilling process and communicates to above surface through the wireline 8, from where it may thus be controlled.

Furthermore, the system 1 comprises a fluid cleaner 5 and a pump 4 for cleaning the drilling fluid while drilling. The pump 4 is driven by the driving unit 7 for sucking fluid through the fluid cleaner 5 and out through the outlets 11 in the drilling head 2. In order to increase the drilling efficiency, fluid is ejected through the outlets 11 in order to tear off pieces from the formation 9 and flush the pieces away from the drilling head 2.

In this embodiment, the pump 4 is furthermore used to power the release device 3. The pump 4 may be any kind of suitable pump. In this embodiment, the pump 4 is a one-step centrifugal pump, but in another embodiment the pump 4 may be a multi-step centrifugal pump, a jet pump, or a piston pump.

Figure 2:
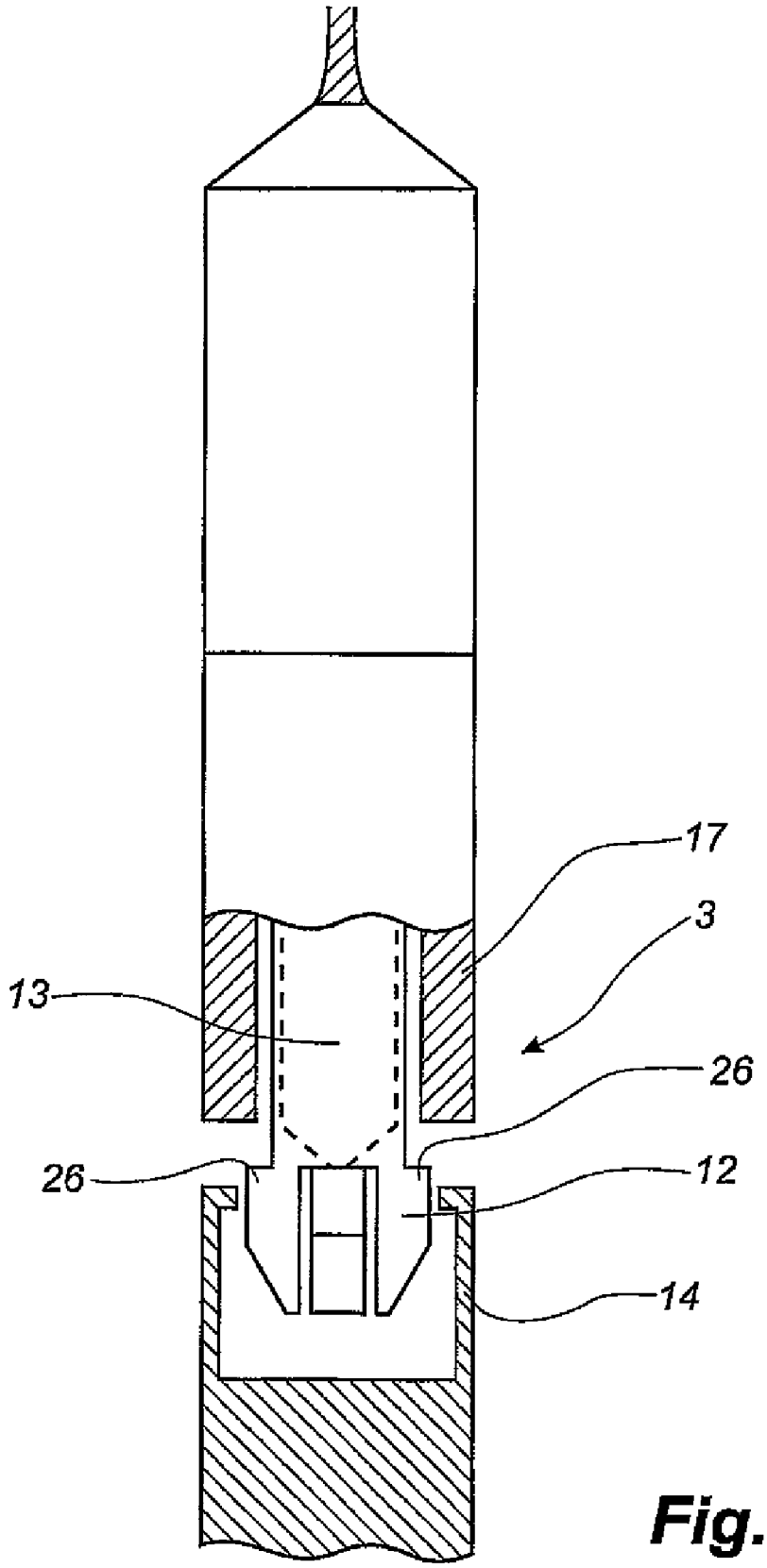
FIG. 2 shows a sectional view of the release device in its released position.
Figure 3:
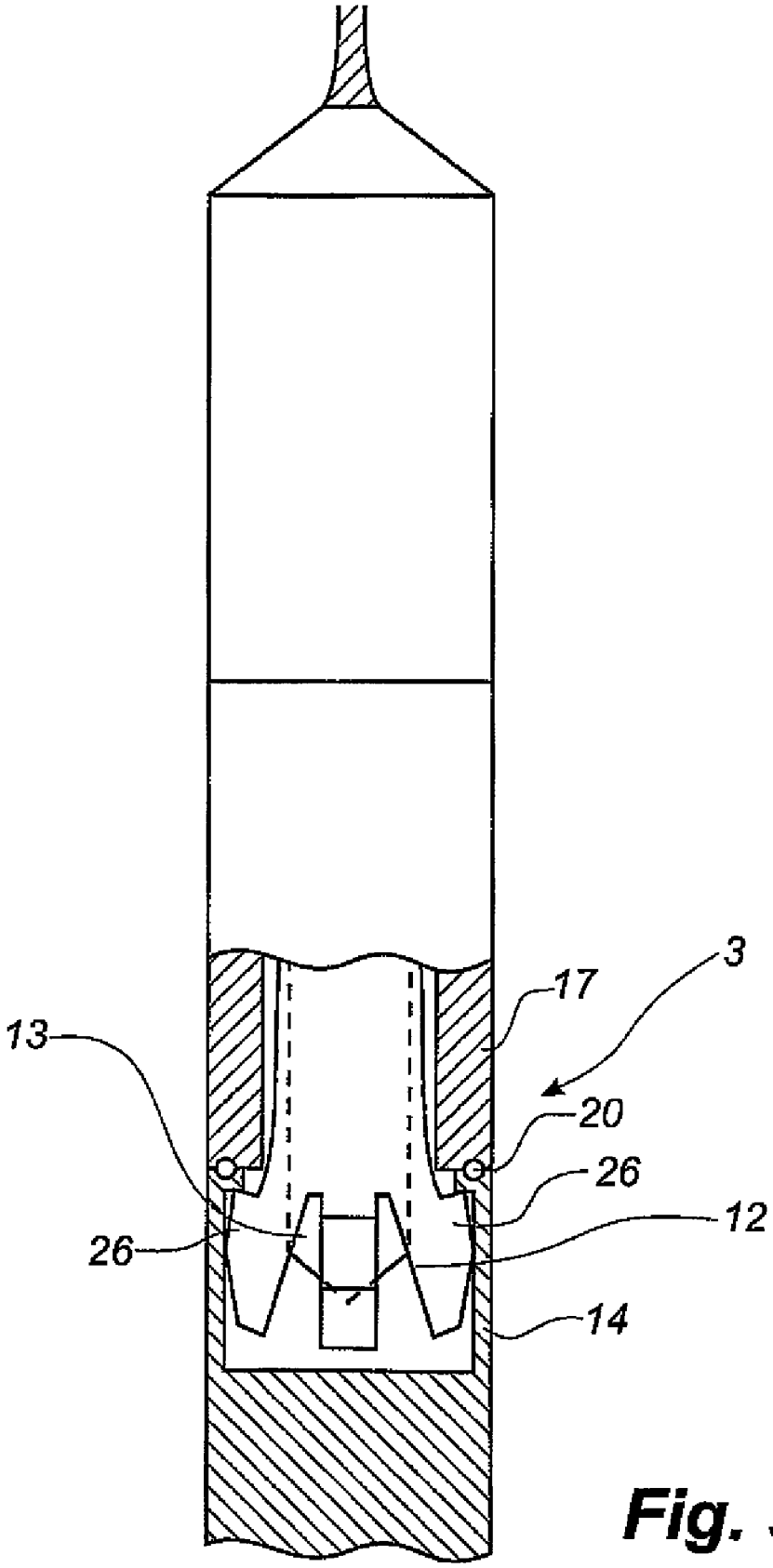
FIG. 3 shows a sectional view of the release device in its unreleased position.

The release device 3 according to the invention is shown in FIGS. 2 and 3. In FIG. 2, the release device 3 is shown in its released position so that a first part of the system 1 is released from a second part of the system 1. In this way, a stuck tool, e.g. a drilling head 2, can be released from the rest of the system 1 so that the only part left downhole is the stuck drilling head 2. The rest of the tools in the system 1 can thus be reused for other purposes or connected to another drilling head 2.

The release device 3 is comprised within a housing of a first part of the system 1 and itself comprises a set of arms 12 for connection to a connection means 14 of an operational tool, such as a drilling tool 2, a packer element, a perforation gun, or the like.

Thus, the release device 3 can be used for releasing part of a stuck tool downhole, but also for retrieving an element downhole, such as a packer element. A packer element is typically used for closing a well downhole and is left there by a tool. The set of arms 12 of the release device 3 is designed so as to fit the collar of most packer elements in order to be able to connect the release device 3 of the downhole system 1 to the packer element and retrieve the element for opening the well again.

The set of arms 12 is movable in a substantially transverse direction to the longitudinal extension of the system 1, and is pushed into engagement with the connection means 14 by a pushing means 13 which moves in the longitudinal extension of the system 1. The pushing means 13 is powered by a power means for pushing the arms 12 in the transverse direction and into engagement with the connection means of the operational tool 2, and thus releases the operational tool when being unpowered.

The pushing means 13 moves substantially in the longitudinal extension of the system 1 from the first part of the system 1 to the second part of the system 1 in order to force the arms 12 into engagement with the connection means 14. The power means powers the pushing means for engagement with the connection means by providing a continuous force on the pushing means. The continuous force may vary during the operation performed by the operational tool.

In the event that the operational tool gets stuck downhole, an operator of the downhole system 1 via a control unit 6 sends the power means a signal to cut off the power forced upon the pushing means 13, after which the pushing means 13 releases its engagement with the connection means 14 of the operational tool 2. In another embodiment, the operator cuts off the electrical connection to the downhole system 1, after which the operational tool 2 is released.

During an operation downhole, the system 1 may loose its electrical connection to above surface or the operator may turn off the electrical connection as mentioned above. When the downhole system 1 is no longer powered by electricity, the power means looses its power to force the pushing means 13 into engagement with the connection means 14, and the pushing means 13 can no longer uphold the above-mentioned continuous force on the pushing means 13. Thus, the pushing means 13 is released from its engagement with the connection means 14, and the operational tool 2 is released and the first part of the tool without the operational tool 2 can be retracted from downhole.

In the event that the electricity is temporarily cut off, the downhole system 1 may release the operational tool temporarily. However, when the electricity returns, the power means regains its power to force the pushing means 13 into engagement with the connection means 14 for fastening of the operational tool. In some tools according to the present invention, the downhole system may have accumulated some standby electricity.

Thus, the downhole system 1 may have a battery which is able to power the tool for a certain amount of time so that the operational tool is not released until the power of the battery is used. The battery is in this way able to compensate for a power failure or interruption to prevent an unwanted release. When the electrical power returns, the battery is recharged.

In one embodiment, the system comprises a timer set to release the operational tool after a predetermined time period which is normally set to around 8-10 hours longer than the expected operation time. The timer sends a signal to the power means to release its power on the pushing means.

The downhole system is powered through a wireline. In order to prevent that the operational tool is released during a power failure, the system has a detection means to detect a current change in the wireline. If no current is present, a reserve power supply, such as a battery, is turned on, and turned off again when the power returns.

In one embodiment, the detection means gives a reset signal to the timer when detecting current in the wireline or wire, whereby the timer is reset. When the downhole system loses its electrical power, the timer starts, and when the predetermined time period of the timer runs out, the operational tool is released.

In one embodiment, the timer is an electrical timer, but it may as well be a mechanical timer. The detection means is a non-contact means such as a pick-up, a coil, a capacitor, a hall element or the like. In another embodiment, the detection means may be a voltmeter or the like being in contact with the current in the wireline or any other wires in the downhole system.

In the embodiment shown in FIGS. 2 and 3, the power means is a hydraulic device, such as a pump, having a piston driven within a piston housing and driven by the driving unit 7. When the piston is forced forward in the housing for pushing the pushing means 13 down towards the set of arms 12, the pushing means 13 forces the arms 12 outwards towards the circumference of the downhole system 1. When the driving unit 7, e.g. an electrical motor, is electrically disconnected, it is no longer able to drive the pump and thereby drive the piston forward in the piston housing for forcing the pushing means 13 downwards. Thus, the set of arms 12 is disconnected from the connection means of the operational tool.

In another embodiment, the power means powers the pushing means 13 by a gear means driven by the driving unit 7. The driving unit 7 forces a gear wheel of the gear means to rotate, whereby the pushing means 13 moves towards the arms and the arms moves into engagement with the connection means. When the power is cut off, the driving unit 7 is no longer able to force the gear wheel to press against the pushing means 13, and the gear wheel rotates backwards until it returns to its initial position. In another embodiment, the power means powers the pushing means 13 via a control unit 6 by use of electricity, e.g. by use of magnetism.

The driving unit 7 is powered through a wireline 8, and when the wireline 8 is destroyed, the driving unit 7 is no longer able to power any part of the downhole system 1. In the case that the downhole system 1 is electrically disconnected, the release device 3 releases the operational tool from the rest of the downhole system 1 and the system 1 can thus always be pulled up to above surface so that the electrical connection can be repaired.

In the event that the operational tool 2 is a perforating gun, the system 1 may be so destroyed during the perforation operation that the system 1 is electrically disconnected. Also, if the operational tool is a drilling tool and the tool gets stuck during the drilling operation, the system 1 may be overloaded and thus loose its power from above surface. Even though the system 1 has been disconnected from power, the release device 3 is still able to release the operational tool 2 so that the rest of the system 1 may be brought up to above surface.

When the downhole system has been repaired, attempts can be made to submerge the system again and to connect to the operational tool in order to bring the tool up to above surface so that a new operation can be initiated.

In FIGS. 2 and 3, the set of arms 12 is constructed as a tube fastened, at its one end, to the first part of the system 1 and slit into a set of arms 12 at its other end. Each arm has a projection for mechanically locking outwards into the collar of the connection means 14 when pushed by the pushing means 13. Each arm tapers at its side facing inward towards a centre of the release device, so that when the pushing means 13 moves downwards, the arms 12 is forced in the transverse direction of the longitudinal extension of the system. The set of arms 12 is here shown as four arms; however, the set may also comprise only two or three arms. The pushing means 13 is provided within the tube and moves downwards for pushing the arms outwards into engagement with a connection means 14 of the operational tool 2. Thus, part of the arms are bend outwards for engaging with the connection means 14. In this embodiment, the connection means 14 has a collar provided in an end opposite the head of the operational tool 2. The pushing means 13 is a mandrel, but may as well itself be a tube.

Figure 4:
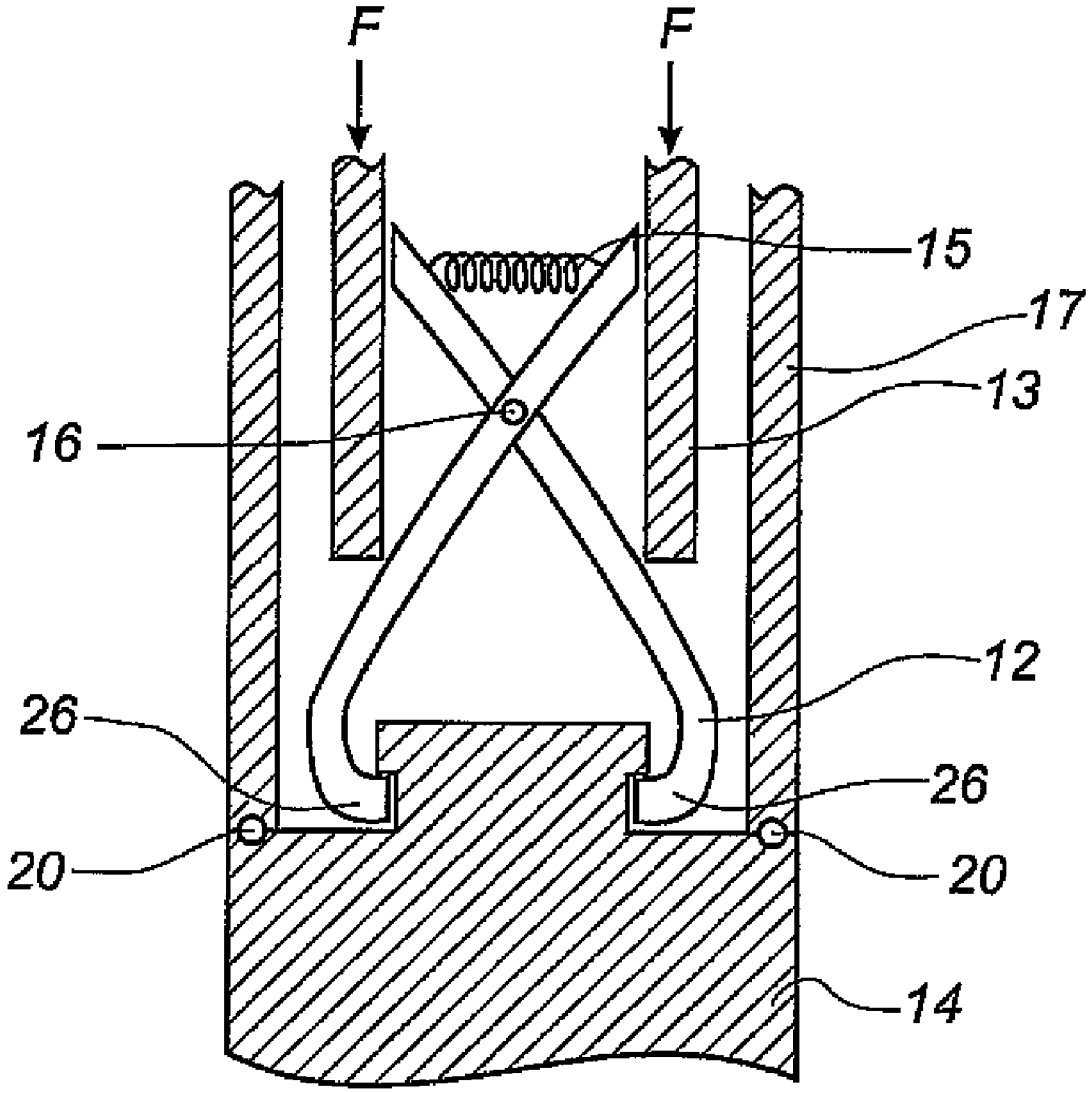
FIG. 4 shows a sectional view of another embodiment of the release device in its unreleased position.

As shown in FIG. 4, the pushing means 13 may also be in the form of a tube. In this embodiment, the pushing means pushes on the outside of a set of two arms 12 in order to press the arms 12 inwards into engagement with a collar of the operational tool 2. When the pushing means 13 no longer forces the arms inwards, the arms 12 are forced outwards by a spring means 15 provided to retract the arms 12 from engagement with the collar 14 of the operational tool 2. The arms are connected for rotation around a point 16 in the form of a spline shaft penetrating both arms. When the release device is in its un-released position, the operational tool and the housing 17 of the first part of the downhole system is further sealed through sealing means 20.

Figure 5:
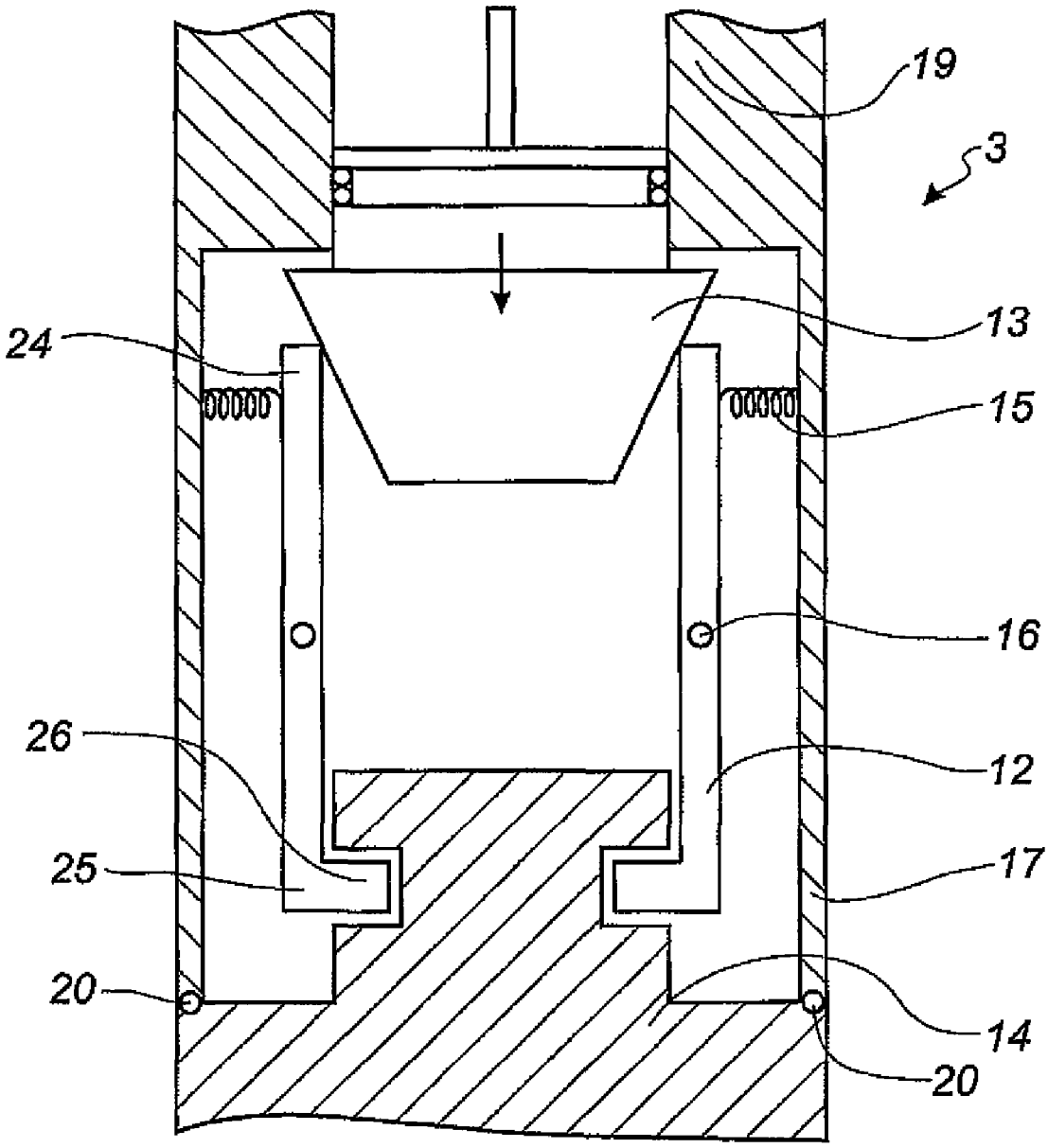
FIG. 5 shows a sectional view of another embodiment of the release device in its unreleased position.

In FIG. 5 the pushing means 13 is in form of a cone 13 pushing towards one end 24 of a set of arms 12 for engagement of the other end 25 of the arms 12 with the connection means 14 of the operational tool 2. The cone 13 is connected to a piston which is sealedly connected to a piston housing 19. Each arm 12 is connected for rotation around a point 16 in the form of a spline shaft penetrating each arm 12. The one end 24 of the arms 12 is forced inwards towards the centre of the system 1 by spring means 15 so as to release the operational tool 2 when the pushing means 13 is no longer pushed towards the one end 24 of the arms. The spring means 15 are connection to the housing 17 of the system 1. Each arm has a projection 26 for mechanically locking the collar by engaging the connection means in a groove just beneath the collar.

The connection means is shown in FIGS. 4 and 5 having a collar and a groove, but may take any shape having one or more projections for engagement with the hook or projection of each arm.

Figure 6:
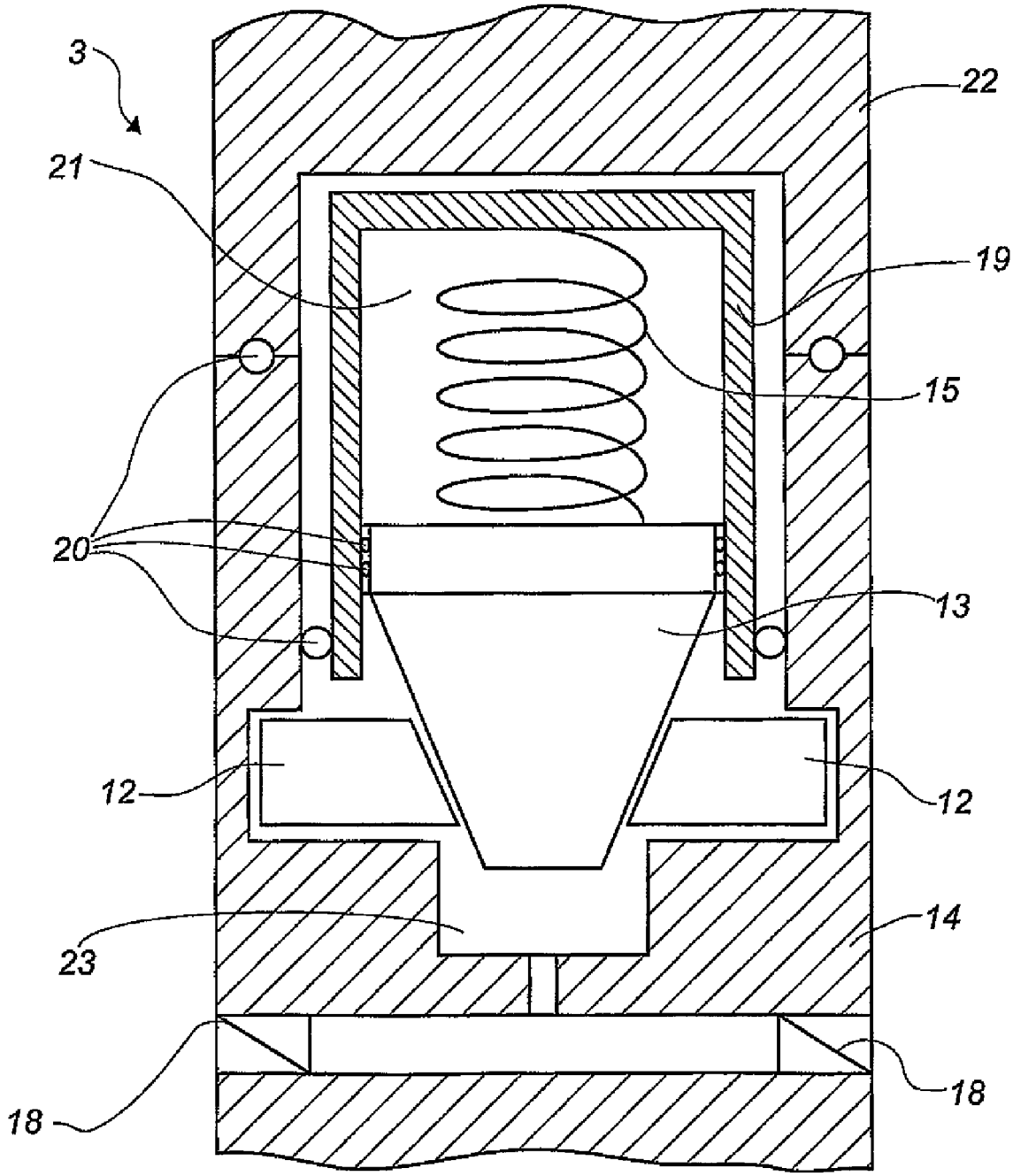
FIG. 6 shows a sectional view of yet another embodiment of the release device in its unreleased position.

In another embodiment shown in FIG. 6, a cone-shaped pushing means 13 is pressed towards a set of arms 12 so that each arm is pushed in the transverse radial direction for engagement with the connection means of the operational tool. The connection means 14 is partly in form of a tube provided with grooves for receiving the arms 12 for engagement therewith. The tube part of the connection means 14 is sealedly connected to an outer housing of the tool 22 when the arms 12 engage with the connection means 14. A spring 15 pushes the cone 13 towards the arms 12. The spring 15 is enclosed in a piston housing 19 wherein a piston part of the cone 13 is placed. The piston housing 19 and the piston part of the cone 13 constitute an enclosure 21 which is sealed by sealing means 20, and the enclosure is filled with a gas, such as air.

In order to release the arms 12 from the connection means 14—and thus to release the operational toll 2 from the rest of the system 1—ports 18 are activated so as to let fluid in through the ports 18 to flush a cavity 23 in which the arms are situated. The cavity 23 is formed between the connection means and the cone. The fluid is taken in from outside the system and is highly pressurised due to the fact that the system is submerged downhole. Thus, the high pressure of the fluid is able to press the cone 13 and thereby the piston into the piston housing 19 and to overcome the force of the spring 15.

When the operational tool 2 is released from the driving unit, the arms 12 fall away from the system and remain in the well together with the operational tool after which the rest of the system is drawn up to above surface.

The activation of the ports 18 is performed by valves situated in the ports. Detection means is situation around a wire in a second part of the system and detects if a current is present in the wire. When the detection means detects a current in the wire, it resets a timer, and when no current is present in the wire anymore, the timer sends a signal to the valve to open in order to let fluid into the tool. The timer and the valve are powered by a battery. The timer is usually set to send a release signal after a predetermined time period so that a power failure does not release the tool.

The valve may be any kind of valve operationable by means of electrical power, such as a magnetic valve.

The ports 18 can also be activated by removing a plug from each port. The plug is held in place by an object, and when this object is removed, the plug falls out of the port and the fluid is able to flush to system.

In one embodiment, the object is held in place by a magnetic valve which releases the object when given a signal from the timer: In another embodiment the object is melted away.

The system 1 is constructed for different purposes and therefore constructed from different tools, such as a pump 4, a fluid cleaner 5, a drilling tool, a perforation gun, a packer element, and the like. In some designs of the system 1, the system 1 is thus constructed that further tools are provided in the second part of the system 1 and released with the operational tool 2 in the event that the operational tool 2 is stuck downhole.

According to the invention, the drilling head 2 may be any type of drilling head. In this embodiment, the drilling head 2 has three rows of bits 10, the head 2 on which the rows are situated rotating in order for the bit 10 to cut chips off the formation. In another embodiment, the drilling head 2 has three wheels with a plurality of bits 10, the wheels rotating in relation to one another during drilling. In yet another example of a drilling head 2, the drilling head 2 has two arms with a plurality of bits 10, the arms rotating while drilling.

By a set of arms 12 movable in a substantially transverse direction to the longitudinal extension of the system is meant any kind of means capable of engaging with the connection means 14 of the operational tool 2, e.g. any kind of means that are not fastened to its surroundings, but only held in place and into engagement with the connection means 14 by its surroundings, such as by the connection means and the pushing means.

In FIG. 1, the downhole system 1 is shown comprising both a fluid cleaner and a pump; however, the system may comprise other tools depending on the operation to be carried out. Thus, the downhole system 1 does not necessarily comprise the fluid cleaner or the pump.

As mentioned above, the operational tool 2 may be a packer element or a perforation gun. However, in another embodiment, the operational tool 2 can be another element, such as a pipeline pig, which is to be brought up from a pipeline or a casing. Thus the downhole system needs not comprise more than a release device 3 and a driving unit.

In the event that the downhole system 1 is not submergible all the way into the casing, a downhole tractor can be used to push the downhole system 1 all the way into position in the well. A downhole tractor is any kind of driving tool capable of pushing or pulling tools in a well downhole, such as a Well Tractor®.

The invention claimed is:

1. A downhole system for performing an operation downhole having a longitudinal extension, comprising:

a driving unit provided in a first part of the system for driving an operational tool, the operational tool being provided in a second part of the system for performing the operation downhole and having a connection means, and a release device provided in the first part of the system, comprising:

a set of arms movable in a substantially transverse direction to the longitudinal extension of the system, and a pushing means movable in the longitudinal extension of the system for pushing the arms in the transverse direction for engagement with the connection means of the operational tool, wherein the pushing means is at least one of a mandrel, a cone, and a tube and is powered by a power means for pushing the arms in the transverse direction and into engagement with the connection means of the operational tool, and releases the operational tool when the power means has been unpowered for a predetermined period of time.

2. The downhole system according to claim 1, wherein the set of arms is freely movable and only held in place and in engagement with the connection means by a configuration of the connection means and the pushing means.

3. The downhole system according to claim 1, wherein the system has a timer which controls the power means for a release of the operational tool.

4. The downhole system according to claim 3, wherein the system is powered through a wireline and the system has a detection means to detect a current change in the wireline.

5. The downhole system according to claim 4, wherein the detection means is a non-contact means.

6. The downhole system according to claim 1, wherein the power means powers the pushing means by use of a hydraulic device and the pushing means is driven by the driving unit via a piston driven by the hydraulic device.

7. The downhole system according to claim 1, wherein the power means powers the pushing means by a gear means driven by the driving unit.

8. The downhole system according to claim 1, wherein the power means powers the pushing means via a control unit by use of electricity.

9. The downhole system claim 1, wherein the set of arms is a part of a tube fastened, at one end of the tube, to the first part of the tool and split into the set of arms at an other end of the tube.

10. The downhole system according to claim 1, wherein the pushing means extends to push the set of arms in the substantially transverse direction.

11. The downhole system according to claim 1, wherein the pushing means moves from the first part of the system towards the second part of the system for engagement with the connection means.

12. The downhole system according to claim 1, wherein the operation downhole is drilling in a formation downhole.

13. An operation method for operating the downhole system according to claim 1, comprising:

turning on electrical power to the downhole system according to claim 1, connecting the operational tool to the downhole system by forcing the pushing means of the downhole system into engagement with the connection means of the operational tool, operating downhole by means of the operational tool, and automatically releasing the operational tool when the power to the downhole system is cut off

* * * * *